United States Patent [19]

Boehm

[11] Patent Number: 5,030,131

[45] **Date of Patent: * Jul. 9, 1991**

[54] ELECTRICAL TERMINAL CONNECTOR

[75] Inventor: William Boehm, Hamilton, Ohio

[73] Assignee: Connector Manufacturing Company, Hamilton, Ohio

[ * ] Notice: The portion of the term of this patent subsequent to Aug. 7, 2007 has been disclaimed.

[21] Appl. No.: 27,764

[22] Filed: Mar. 19, 1987

[51] Int. Cl.[5] ..... H01R 4/34

[52] U.S. Cl. ..... 439/387; 439/810; 439/883

[58] Field of Search ..... 439/793, 810, 811, 812, 439/813, 814, 387

[56] References Cited

U.S. PATENT DOCUMENTS

| | | | |
|---|---|---|---|
| 1,499,098 | 6/1924 | Cassard | 439/812 |
| 1,912,653 | 6/1933 | Olson | 439/741 |
| 2,049,409 | 7/1936 | Dibner | 439/810 |
| 2,188,135 | 1/1940 | Lee et al. | 439/810 |
| 2,737,637 | 3/1956 | Scott | 439/793 |
| 3,344,316 | 9/1967 | Stelmak | 439/387 |
| 3,609,657 | 9/1971 | Stanback | 439/814 |
| 3,714,384 | 1/1973 | Burkhardt et al. | 439/387 |
| 3,775,733 | 11/1973 | Ege | 439/814 |
| 4,146,290 | 3/1979 | Annas et al. | 439/810 |
| 4,327,957 | 5/1982 | Cooper, Jr. et al. | 439/814 |

FOREIGN PATENT DOCUMENTS

| | | | |
|---|---|---|---|
| 548206 | 9/1956 | Italy | 174/78 |
| 539594 | 9/1941 | United Kingdom | 439/733 |

*Primary Examiner*—Gary F. Paumen

*Attorney, Agent, or Firm*—Biebel & French

[57] ABSTRACT

An improved solderless electrical terminal connector includes a plurality of serrations or notches formed on its lower surface for improving the electrical and thermal contact between the connector and the surface onto which it is mounted. The wire receiving portion of the connector includes a set screw for holding the wire securely in place in a body member. The cross-sectional area of the body member in the direction of the wire is reduced so that it is less than the diameter of the set screw thereby to improve pullout characteristics. The opening for the wire in the body member extends into a tang to form a stop to provide for ease of installation of the wire. This placement of the wire will also reduce electrical resistance. In an alternate embodiment, a spiral groove may be formed in the wire receiving opening to cut into the wire as it is clamped in place both to improve pullout characteristics and to lower the electrical resistance between the wire and the connector.

2 Claims, 2 Drawing Sheets

ELECTRICAL TERMINAL CONNECTOR

BACKGROUND OF THE INVENTION

This invention relates to an improved solderless electrical terminal connector, or lug, providing low electrical resistance connection between a wire and a bus, or other object to which the lug is connected. The connector also provides for improved gripping of the wire.

Electrial terminal connectors employing set screws to secure a wire to the connector have been in use for many years, as shown in U.S. Pat. No. 3,638,173. Such connectors typically include a body portion provided with an opening into which the wire is inserted, a set screw to clamp the wire in place, and an elongated tang extending from the body that may be provided with a hole through which a mounting screw is inserted to secure the tang in electrical and mechanical contact with a bus bar, or other similar electrical component.

In order for connectors of this type to be efficient, the contact surface of the tang must mate over a large area with the bus, but unfortunately, if either or both the tang and bus surface are not perfectly flat, then the actual area of contact between them is reduced with the result that electrical resistance between them may be increased sufficiently that heat will be generated and hot spots created, all with undesirable results.

Further, it is essential that the wire be held firmly by the connector, that the wire not pull out from the body of the connector, but in conventional connectors of this type, no means are generally provided to increase or improve the force required to pull the wire out of the connector.

SUMMARY OF THE INVENTION

This invention provides a solderless terminal connector for joining an electrical wire to a bus bar, or other similar electrical component, which provides for an improved electrical connection between the wire and the connector and between the tang member of the connector and the bus, and which further provides for improved wire pull-out characteristics.

In a preferred embodiment of the invention, the lower surface of the tang, or the surface of the tang that engages the bus, is serrated. The serrations ensure that there will be multiple areas of electrical and thermal contact between the terminal and the bus, thus eliminating hot spots and improving the overall performance of the connector as compared to prior art devices.

Further, this invention provides that the screw which extends through the body of the connector to clamp the wire in place is wider than the wire itself. The body portion of the connector is reduced in the dimension parallel to the wire to allow for the expansion of the wire outside the body as the screw is tightened. Because the wire is expanded outside the lug, the force required to pull the wire through the body is substantially increased. At the same time, this construction utilizes the least amount of metal necessary for optimum results, thus reducing the price of connectors so constructed.

Additionally, where maximum mechanical strength is required, grooves may be cut into the wire receiving opening of the connector so that, as the wire is clamped in place, the grooves will cut into the wire, thus improving both pullout characteristics and reducing electrical resistance. These grooves are preferably spiral cut, like screw threads. This positive cutting into an aluminum conductor, for example, eliminates the need for wire brushing by the installer prior to inserting the wire into the connector.

The opening in the body for receiving the wire is placed at the lowest point near the tang to reduce the distance through which electrical current must travel. This construction improves the current carrying ability of the connector and assists in the initial placement of the wire during installation. A recess is formed in the upper surface of the tang to receive the wire. The innermost extent of this recess forms a wire stop to limit the wire's movement into the tang.

Accordingly, it is an object of this invention to provide an improved electrical connector of the type described wherein serrations are formed on that portion of the tang that engages a bus to improve the area of electrical contact therebetween, thus lowering the electrical resistance of the contact; to provide an electrical connector wherein a minimum amount of metal is used to form the body member which, at the same time, provides for the expansion of the conductor or wire as it is tightened in place, thus improving pull-out characteristics; and to provide an improved connector wherein a spiral groove is formed in the wire receiving opening to improve both pullout characteristics and to further lower electrical resistance between the wire and the connector.

Other objects and advantages of the invention will be apparent from the following description, the accompanying drawings and the appended claims.

DESCRIPTION OF THE PREFERRED EMBODIMENT

Figure 1:
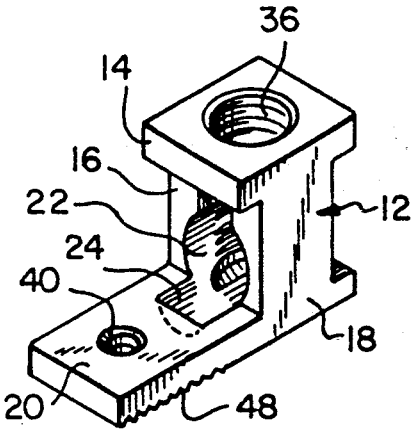
FIG. 1 is a perspective view of a preferred embodiment of the connector constructed according to the present invention.

Referring now to the drawings which illustrate the invention, and particularly to FIGS. 1-4, a solderless electrical terminal connector or lug 10 comprises a body member 12 having upper, central and lower body portions (14, 16 and 18, respectively), and an elongated tang 20 formed integrally with and extending from the lower body portion 18 to the left, as shown, and tang 21 extending to the right. As shown, the tang is rectangular in cross-section and is provided with flat or planar upper and lower surfaces.

Figure 2:
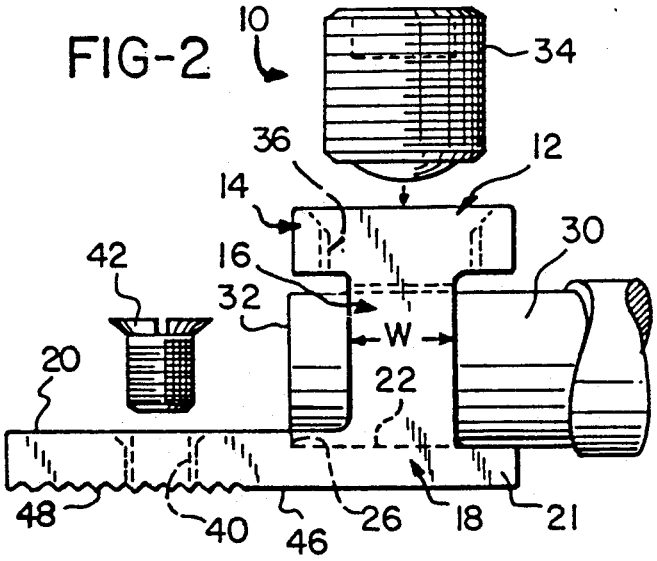
FIG. 2 is a side elevational view of the connector of FIG. 1.
Figure 4:
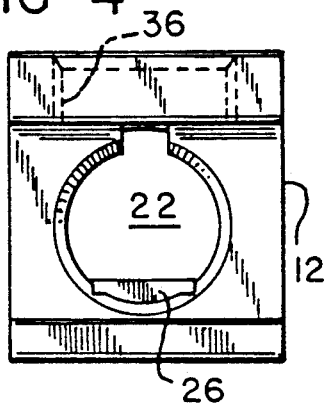
FIG. 4 is a left end elevational view of the connector of FIG. 1.

A wire receiving opening 22 is formed in the central portion 16 of the body member. The central axis of the opening is oriented substantially parallel both to the plane of the tang 20 and lengthwise direction of the tang. As shown in FIGS. 1, 2 and 4, this opening extends into the upper surface of the tang to form a recess 24 with the interior end of the recess forming a wire stop 26. As the wire 30 is inserted into the opening, the end 32 of the wire will abut the wire stop 26, correctly positioning the wire so that it may be clamped securely in the opening by means of the set screw 34.

Placing the wire as close to the lower surface of the connector as possible reduces the distance through which the electrical current must flow. This not only lowers resistance, but improves the heat transfer characteristics of the device.

The upper portion 14 of the body is provided with a threaded aperture 36 for receiving the set screw 34. As may be seen in FIG. 2, the width, W, of the body member in the central portion 16 thereof is smaller than the diameter of the screw 34. This construction allows the wire to both the left and the right of the central portion to expand as the set screw is tightened against the wire. That portion of the wire to the left of the body member (as seen in FIG. 2), when it expands, can approach and exceed the size of the wire receiving opening 22, thereby increasing substantially the force that will be required to pull the wire 30 out of the body 12.

This construction also has a secondary advantage of requiring less metal to form the connector, thus reducing both its weight and cost while at the same time improving its performance.

In the embodiment shown in FIGS. 1-4, the cross-section configuration of the central portion of the body member is rectangular as viewed in a plane parallel to the plane formed by the lower surface of the connector. That cross-sectional configuration could take any other shape, such as circular, oval, etc. Also, while the central portion 16 of the body is shown as rectangular in FIGS. 1 and 2, this could also be in circular or V-shaped configurations as well.

Figure 3:
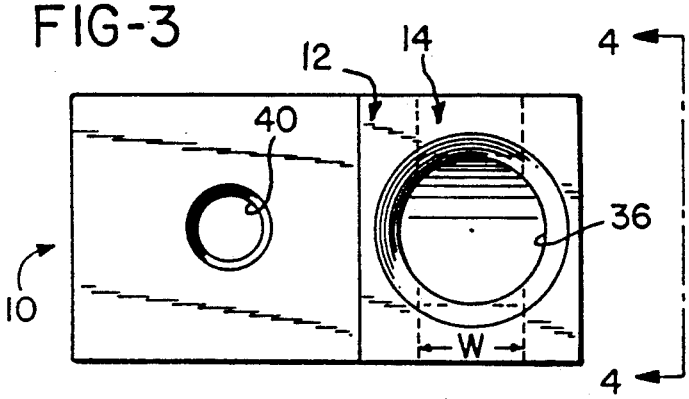
FIG. 3 is a plan view of the connector of FIG. 1.

A mounting aperture 40 is formed in the central part of the tang 20 to the left of the body (as shown in FIGS. 1-3), and a set screw placed through the aperture into a threaded opening in the surface of the bus onto which the connector is to be mounted (not shown) will securely attach the connector to that mounting surface.

The lower surface 46 of the tang is provided with a plurality of serrations or notches 48, as shown in FIGS. 1 and 2, primarily for improving the electrical and mechanical contact of the connector with the mounting surface. These serrations 48 typically are in the range of 1/64 to 1/16-inch in depth, with the number of serrations depending upon the length of the tang. Typically, there will be 10 to 20 notches formed per inch. As shown, the notches are formed in the area immediately surrounding the mounting aperture, but it is understood that they can extend for the entire length of the lower surface of the connector.

These serrations are preferably extended as the material is formed. Thus, the exterior edges of these serrations provide multiple areas of contact between the connector 10 and the mounting surface of the bus to which it is attached. This assures that there will be adequate thermal and electrical contact even if the mounting surface of the bus or the lower surface of the tang is not perfectly planar. This eliminates hot spots and improves performance.

By comparison with the prior art connectors, the electrical connector described in this application shows a noticeable improvement in both heating characteristics and mechanical secureness. In a direct comparison between the assignee's standard LA series of connectors constructed according to the prior art, and applicant's new AB series of connectors constructed according to the present invention, the following results were obtained during a qualification test.

With regard to heating while current is passing through the connector in accordance with Underwriters Laboratory test UL486B, with an allowable variation of ±10° C., the following results were obtained.

TABLE A

| Cat. No. | Stab | Cat. No. | Stab |
|---|---|---|---|
| LA-50 | +9 | AB-50 | +5 |
| LA-125 | +10 | AB-2/0 | +8 |
| LA-360 | −7 | AB-350 | +4 |
| LA-1000 | +8 | AB-1000 | +6 |

With respect to mechanical secureness, these same connectors were compared against the Underwriters Laboratory minimum requirements for pull-out strength,

TABLE B

| UL Req'd. | Cat. No. | Force/lbs | Cat. No. | Force/lbs |
|---|---|---|---|---|
| 100 | LA-50 | 320 | AB-50 | 340 |
| 300 | LA-125 | 400 | AB-2/0 | 410 |
| 600 | LA-360 | 1190 | AB-350 | 1280 |
| 1000 | LA-1000 | 1990 | AB-1000 | 2300 |

Those skilled in the art will recognize that the AB series connectors, incorporating the features of this invention in all current ranges, provide significant improvements both in electrical and mechanical contact between the wire and the connector and between the connector and the mounting surface.

The invention can be embodied in many forms, a few of which will now be briefly described. Components in these alternate embodiments similar to those shown in FIGS. 1-4 will be identified with the same reference number.

Figure 5:
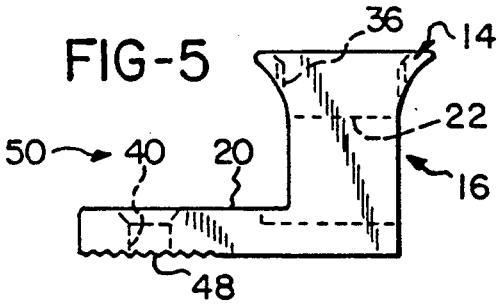
FIG. 5 is a side elevational view of an alternate embodiment of the present invention.

In the embodiment of the invention, illustrated in FIG. 5, connector 50 includes a body member 12, tang 20, mounting aperture 18 and wire receiving opening 22 as described above. As shown, the connector 50 does not include the righthand tang 21. In this embodiment, the width of the body from the upper portion 14 to the central portion 16 is reduced gradually and forms the smooth curve shown. Of course, other configurations could be employed, if desired.

Figure 6:
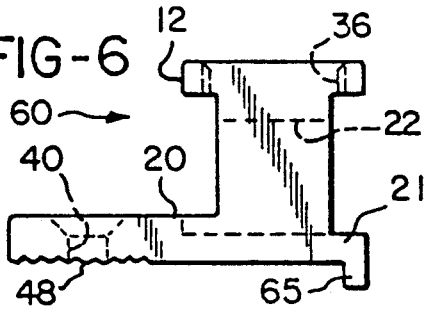
FIG. 6 is a side elevational view of another alternate embodiment of the invention showing a rail integrally formed thereon.

Another embodiment, indicated generally at 60, of the present invention is illustrated in FIG. 6. The connector 60 includes a rail 65 formed integrally with the tang 21. The rail 65 can be of any desired configuration, and for purposes of illustration only, the rail 65 is shown having a substantially rectangular cross-section. The rail 65 is designed to mate with a corresponding slot in the mounting surface to prevent rotation of the connector.

Figure 7:
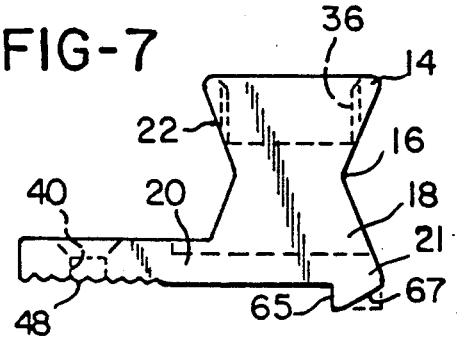
FIG. 7 is a side elevational view of another alternate embodiment of the invention.
Figure 8:
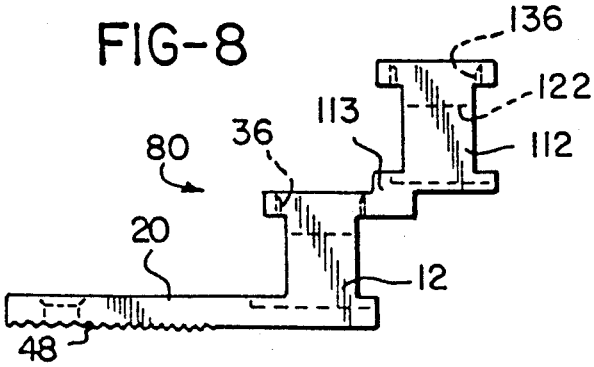
FIG. 8 is a side elevational view of an embodiment of the present invention similar to that of FIG. 2 but showing a second body portion connected to and stacked with respect to a first body portion.

An alternate configuration, indicated generally at 70, is illustrated in FIG. 7. Here, the body member 12 resembles an hourglass shape and the rail 65 is beveled at 67.

Other combinations of body portions 12 and tangs 20 are illustrated in FIGS. 8–12. A connector 80 illustrated in FIG. 8 includes a pair of stacked body portions 12 and 112 joined together as at 113. It will be apparent that body portions 12 and 112 are stacked in a step fashion so that each may be provided with a threaded set screw bore 36 and 136 in their respective upper surfaces. Body portions 12 and 112 can be of any appropriate configuration (including those set forth above) and the tang 20 could include a rail, if desired. Any number of body portions 12 can be stacked in this manner.

Figure 9:
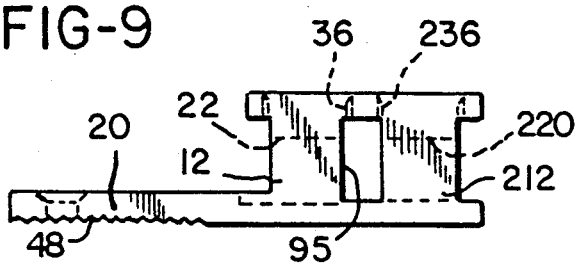
FIG. 9 is an alternate embodiment of the present invention showing a second body portion connected to the first body portion in a side-by-side manner.

FIG. 9 illustrates a connector 90 having a pair of body portions 12 and 212 connected in side-by-side or tandem fashion. For purposes of illustration only, the wire receiving opening 22 of body portion 12 is shown perpendicular to the longitudinal axis of tang 20. The wire receiving hole 220 of body portion 212 is also shown parallel with the longitudinal axis of tang 20. A window 95 is shown in FIG. 9 separating the central parts of body portions 12 and 212. If desired, the window 95 can be reduced or completely eliminated. While not shown in FIG. 9, a rail can be added as desired. Any number of body portions 12 can be combined in this manner.

Figure 10:
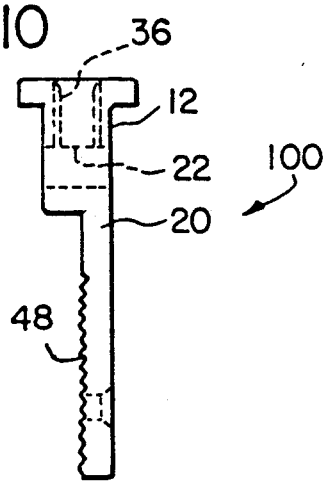
FIG. 10 is a side elevational view of an alternate embodiment of the present invention having a tang mounted so that its longitudinal axis is parallel to the longitudinal axis of the body member.

In FIG. 10, a connector 100 includes a tang 20 connected to the body portion 12 so that the longitudinal axis of the tang 20 is perpendicular to the axis of bore 22. The notches 48 on the tang 20 can be oriented to either the left surface (as illustrated) or the right surface, as desired.

Figure 11:
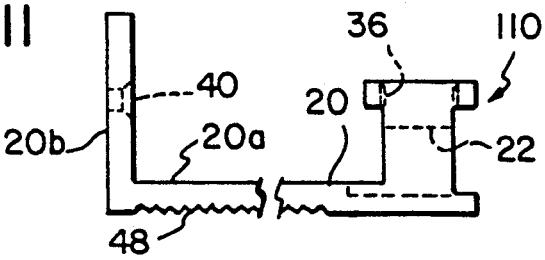
FIG. 11 is a side elevational view of an alternate embodiment of the present invention showing an L-shaped tang connected to the body portion.

A connector 110 illustrated in FIG. 11 includes an L-shaped tang 20. The notched surface 48 can be provided either on the horizontal leg **20*a* (as illustrated) or the vertical leg 20*b* of tang 14. The legs 20*a* and 20*b* can be of any desired length. A mounting aperture 40** may be provided in the horizontal leg or vertical leg (as illustrated), or both.

Figure 12:
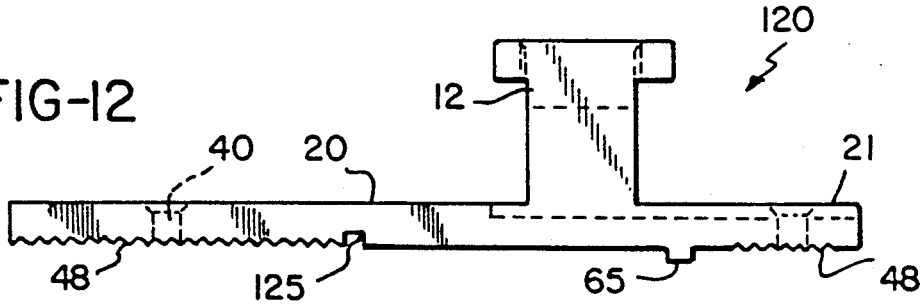
FIG. 12 is a side elevational view of a connector whose tang includes both a rail and a slot.

A connector 120 illustrated in FIG. 12 includes a first tang 20 and an elongated second tang 21. A notch or slot 125, which can extend the width of the tang 14, is adapted to receive a lug or protrusion (not shown) formed in the mounting surface. Tang 21 may include a rail 42.

Figure 13:
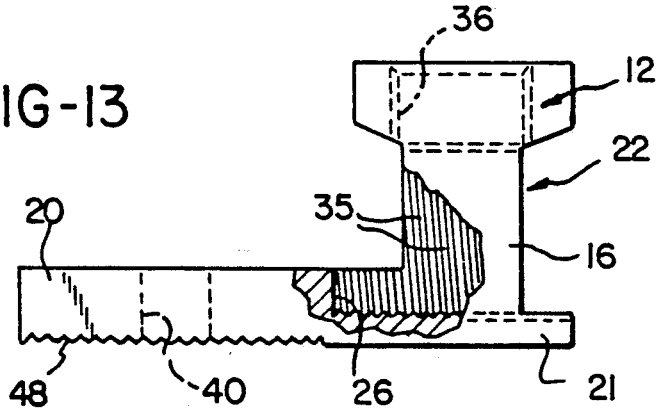
FIG. 13 is a side elevational view of another embodiment of a connector having a spiral groove cut in the wire receiving opening.

In FIG. 13, grooves 135 are cut into the wire receiving opening 22. These grooves are much like screw threads and further improve the grip of the conductor on the wire. As the set screw 34 is tightened, these grooves will cut into the wire, thus making the connection secure even under shock conditions (power surges) as well as improving pullout characteristics. The grooves will cut into any insulation that may be on the strands of the wire conductor so that resistance is lowered to a minimum. This positive cutting action into an aluminum conductor will eliminate the need for wire brushing by the installer since a direct contact is made into the wire in spite of any oxide on the outer surface.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An electrical connector for terminating the end of an electrically conductive wire comprising:

a body member having upper, central and lower portions;

a least one elongated tang formed integrally with and extending from said lower body portion, said tang having a lower surface for engaging a mounting surface and means forming a mounting aperture extending therethrough;

means forming a wire receiving opening extending through said central body portion and substantially parallel to the plane of the tang;

a screw extending downwardly through the upper body portion for clamping the wire securely in said wire receiving opening; and said central body portion, in the dimension parallel to the axis of the wire receiving opening, being smaller than the diameter of said screw, said diameter being at the point where said screw meets the wire whereby, as said screw is tightened against the wire, that portion of the wire extending through the body will be expanded to a size larger than the wire receiving opening, thereby increasing substantially the force required to pull the wire out of said body.

2. An electrical connector for terminating the end of an electrically conductive wire comprising:

a body member having upper, central and lower portions;

at least on elongated tang formed integrally with and extending from said lower body portion, said tang having a lower surface for engaging a mounting surface and means forming a mounting aperture extending therethrough;

means forming a plurality of notches in the lower surface of the tang for improving the electrical and thermal contact of the connector with the mounting surface;

means forming a wire receiving opening extending through the central body portion and substantially parallel to the plane of the tang;

a screw extending downwardly through the upper body portion for clamping the wire securely in said wire receiving opening;

said central body portion, in the dimension parallel to the axis of the wire receiving opening, being smaller than the diameter of said screw, said diameter being at the point where said screw meets the wire whereby, as said screw is tightened against the wire, that portion of the wire extending through the body will be expanded to a size larger than the wire receiving opening, thereby increasing substantially the force required to pull the wire out of said body;

means forming a plurality of grooves on the surface of the wire receiving opening for cutting into the wire as it is clamped, thereby providing a mechanically secure and low electrical resistance connection;

means extending from said wire receiving opening for forming a recess in the upper surface of said tang to receive the wire; and means for forming a wire stop at the interior end of said recess for assisting in the initial placement of the wire during installation.

* * * * *